US005816505A

United States Patent [19]

Tran et al.

[11] Patent Number: 5,816,505

[45] Date of Patent: Oct. 6, 1998

[54] FLUID JET DECOKING TOOL

[75] Inventors: Richard Tran, San Gabriel; Robert M. Purton, Long Beach, both of Calif.

[73] Assignee: Ingersoll-Dresser Pump Company, Liberty Corner, N.J.

[21] Appl. No.: 842,860

[22] Filed: Apr. 17, 1997

[51] Int. Cl.[6] ..... C10C 3/18

[52] U.S. Cl. ..... 239/443; 239/447; 239/449; 239/550; 239/581.1; 239/DIG. 13; 137/625.46; 299/81.2

[58] Field of Search ..... 239/436, 443, 239/446, 447, 448, 449, 548, 550, 569, 578, 581.1, DIG. 13; 137/625.46, 876; 175/339, 393; 299/17, 81.2

[56] References Cited

U.S. PATENT DOCUMENTS

| | | | |
|---|---|---|---|
| 1,128,178 | 2/1915 | Nedbor | 239/449 X |
| 3,964,516 | 6/1976 | Purton et al. | 137/625.38 |
| 4,275,842 | 6/1981 | Purton et al. | 239/446 |
| 4,611,613 | 9/1986 | Kaplan | 134/95 |
| 4,673,442 | 6/1987 | Kaplan | 134/24 |
| 4,738,399 | 4/1988 | Adams | 239/447 |
| 4,828,651 | 5/1989 | Lumbroso et al. | 201/2 |
| 4,923,021 | 5/1990 | Courmier et al. | 175/382 |
| 4,959,126 | 9/1990 | Tong et al. | 201/2 |
| 5,076,893 | 12/1991 | Tong et al. | 202/241 |
| 5,092,963 | 3/1992 | Barker et al. | 202/250 |
| 5,624,073 | 4/1997 | Mueller et al. | 239/447 X |

*Primary Examiner*—Lesley D. Morris
*Assistant Examiner*—Robin O. Evans
*Attorney, Agent, or Firm*—Robert F. Palermo

[57] ABSTRACT

A decoking tool includes a valve body equipped with a pressurized fluid inlet and having a plurality of fluid passages, including drilling fluid passages extending substantially the full length of the valve body to conduct fluid to drilling nozzle sockets, and cutting fluid passages extending approximately half as far as the drilling fluid passages to conduct fluid to cutting nozzle sockets, the drilling and cutting fluid passages being disposed alternatingly on a circular locus about an axial centerline of the valve body. There are nozzles installed in the nozzle sockets. A diverter plate is interposed between the valve body and the pressurized fluid inlet and has axial fluid passages disposed on a circular path congruent with the circular locus, the disposition of the axial fluid passages being such that the passages align either with the drilling fluid passages or with the cutting fluid passages of the valve body. Means are provided for rotating the diverter plate to selectively provide fluid communication to either the drilling fluid passages or the cutting fluid passages.

11 Claims, 6 Drawing Sheets

FLUID JET DECOKING TOOL

BACKGROUND OF THE INVENTION

This invention relates generally to tools for removing coke from containers such as coking drums used in oil refining and more particularly to a more durable coke cutter having a simpler method of operation and a more easily manufactured construction.

During the distillation of heavy oils to remove more valuable lighter distillates, some of the lightest constituents are removed in a fractionation vessel. The heavy remaining oils are drained from the fractionator, heated, and injected into very large vessels at a temperature sufficient to drive off the remaining volatile materials. After such heating, the residue remaining in the vessel is essentially solidified petroleum coke which must be broken up in order to remove it from the vessel. This removal process is referred to as "decoking" and is accomplished, preferably, by using high-pressure water directed through nozzles of a decoking (or coke cutting) tool.

Most decoking tools have drilling or boring nozzles and cutting nozzles, one or the other of which is operated at any time. Since flows of 1000 gallons per minute (gpm) at 3000–4000 pounds per square inch (psi) are typically used for such operations, it is neither practical nor desirable to open drilling and cutting nozzles at the same time. Thus diverter valves are needed to direct the flow to the selected nozzles as required for the decoking operation. There are two commonly used diverter valve designs, both of which are complex, require numerous components, and require a very high level of precision in their manufacture in order to function.

One such valve is a reciprocatable sleeve type valve having radial ports which selectively align with corresponding ports in the valve body to direct flow to either the drilling or cutting nozzles. The other is a rotatable sleeve, again having ports for selective alignment with corresponding ports of the valve body. In a more benign environment, both designs would provide adequate diversion control and operation. However, during the drilling and cutting operations, the water used is recycled over and over, and it contains a quantity of suspended coke fines. This results in failure of seals and jamming of the sleeve in the valve body to render the valve and the decoking tool inoperative. The same result occurs whether the valve is moved by springs or pneumatic or manual means. Once jammed, the tool must be removed, disassembled, and cleaned before decoking can be resumed. Considering the environment in which these tools must function, it is clear that tool breakdowns and maintenance problems are in direct proportion to the number of moving parts and the interfaces between those parts.

The foregoing illustrates limitations known to exist in present decoking tools and their diverter valves. Thus, it would clearly be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a decoking tool comprising a valve body equipped with a pressurized fluid inlet, having an axis and a plurality of axially extending fluid passages, including drilling fluid passages extending substantially the full length of said valve body to conduct fluid to drilling nozzle sockets, and cutting fluid passages extending approximately half as far as said drilling fluid passages to conduct fluid to cutting nozzle sockets, said drilling and cutting fluid passages being disposed alternatingly on a circular locus about an axial centerline of said valve body; a plurality of nozzles installed one in each of said nozzle sockets; a diverter plate interposed between said valve body and said pressurized fluid inlet and having axial fluid passages disposed on a circular path congruent with said circular locus, the disposition of said axial fluid passages being such that said passages align either with the drilling fluid passages or with the cutting fluid passages of the valve body; and means for rotating said diverter plate to selectively provide fluid communication to either the drilling fluid passages or the cutting fluid passages.

The foregoing and other aspects will become apparent from the following detailed description of the invention when considered in conjunction with the accompanying drawings.

DETAILED DESCRIPTION

Figure 1:
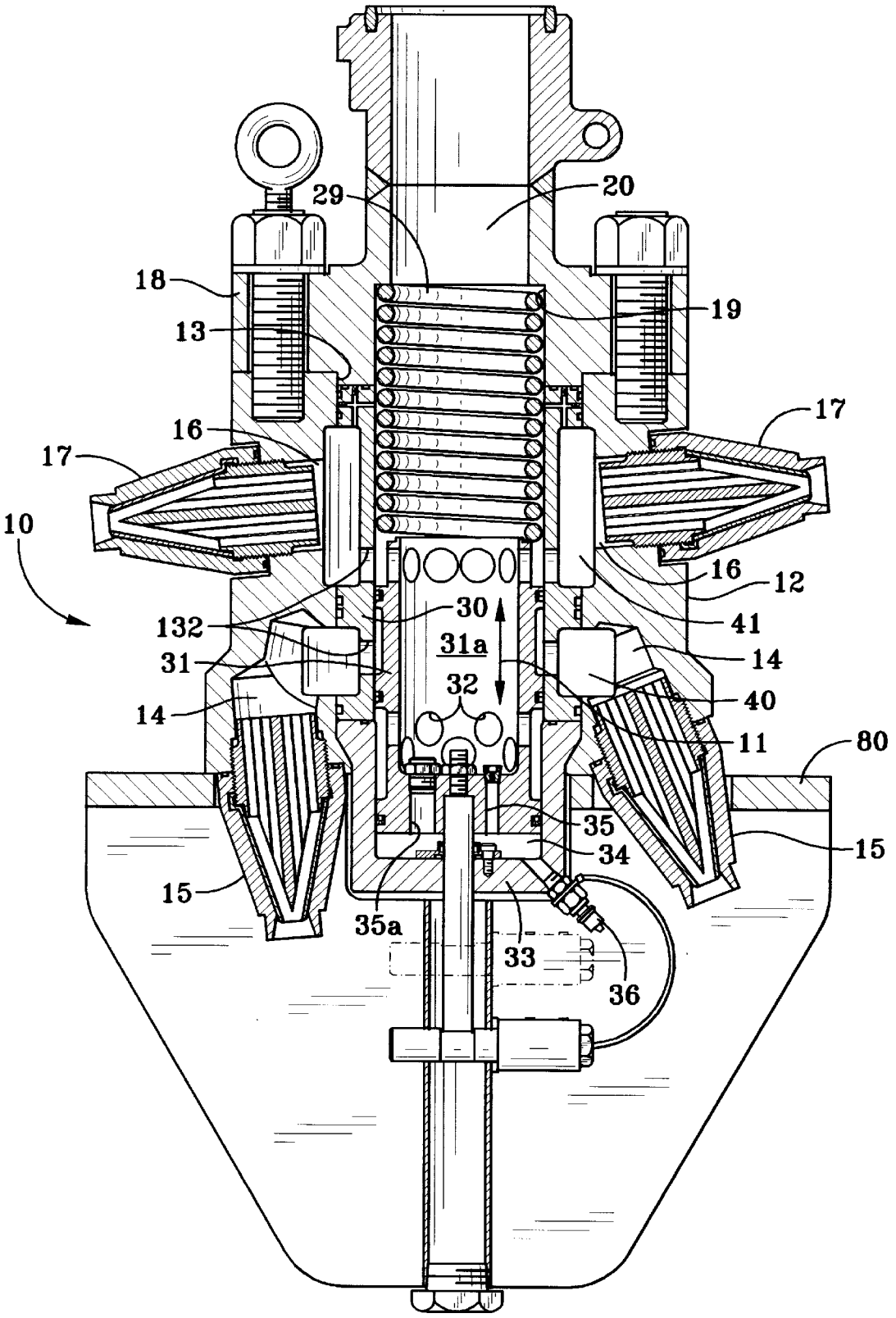
FIG. 1 (PRIOR ART)
FIG. 1 is a cross-sectional elevation view of a reciprocatable-valve version of a decoking tool of the prior art.

FIG. 1 shows a cross-sectional elevation view of a decoking tool 10 of the prior art, which has a valve body 12 including a cylindrical axial bore 13 with a reciprocatable spool type valve 11 for selecting between drilling and cutting actions. Valve body 12 is mounted to a mounting plate 80 using bolts or other suitable attachment methods. The reciprocatable spool valve 11 consists of a valve body liner 30, which has radial ports 132 leading to drilling fluid plenums 40 and cutting fluid plenums 41, which connect with nozzle sockets 14 and 16. The valve body liner 30 has a smooth cylinder bore in which is fitted a reciprocatable valve piston member 31. Piston member 31 has an internal axial chamber 31*a* which is open to the pressurized fluid inlet 20. Radial ports 32 are provided in piston member 31 and are spaced such that they align with the ports 132 of valve body liner 30 that lead to either the cutting fluid plenum 41 or the drilling fluid plenum 40 but never with both plenums at the same time. A spring 29, mounted in spring socket 19 of the valve body flange 18, biases the valve piston member 31 toward alignment with the cutting fluid plenum 41. It should be noted that, in all Figures, the representations of nozzle positions on a single vertical plane is only for convenience in describing the tool. In fact, there may be different numbers of drilling and cutting nozzles, which may or may not lie on a common plane. For example, three equally spaced drilling nozzles could not lie on a common vertical plane.

When fluid pressure to the tool is cut off and air pressure is connected to the air connection fitting 36, the chamber 34, lying between the valve body liner extension 33 and the head of piston 31, is pressurized. This drives the piston 31 upward until the lower ports 32 align with ports 132 of the liner 30 which lead to drilling fluid plenum 40. A check valve 35*a* permits equalization of pressure between chamber 31*a* and chamber 34 during fluid-pressurized operation in order for the piston 31 to remain in its set position. Bleed valve 35 allows damping by controlled venting of pressure from chamber 34 when fluid pressure is removed from chamber 31*a*, and spring 29 forces piston 31 downward in the valve body liner 30 to change to cutting operation from drilling operation.

Because of the presence of the extremely fine coke particles in the pressurized fluid; the reciprocating piston valve design described above is subject to frequent malfunctions due to infiltration and compaction of such particles between the liner and piston, between spring coils, in seal grooves, and in all interfacial areas. These require shutdown, disassembly, cleaning, repair, and reassembly of the tool.

Figure 2:
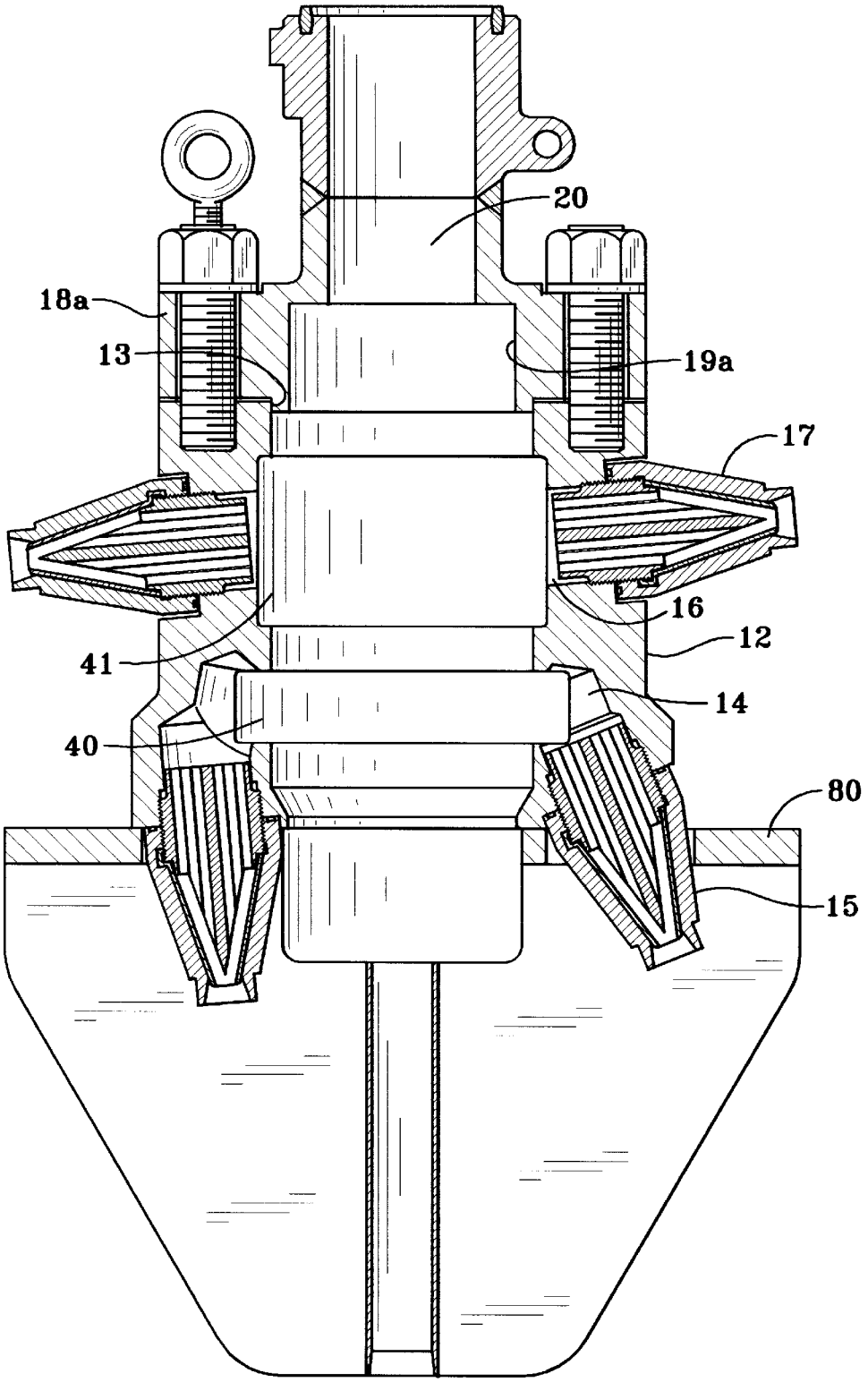
FIG. 2 is a cross-sectional elevation view of a decoking tool body of the prior art modified to accept a diversion valve according to the present invention.

FIG. 2 shows the valve body 12 of FIG. 1 with all components of the reciprocatable spool valve removed. The valve body flange 18*a* has also been modified to incorporate a larger socket 19*a*. The valve body 12 is unchanged and still has the cylindrical axial bore 13, the annular drilling fluid plenum 40, the annular cutting fluid plenum 41, cutting and drilling nozzle sockets 16, 14, cutting and drilling nozzles 17, 15, and a mounting plate 80.

Figure 3:
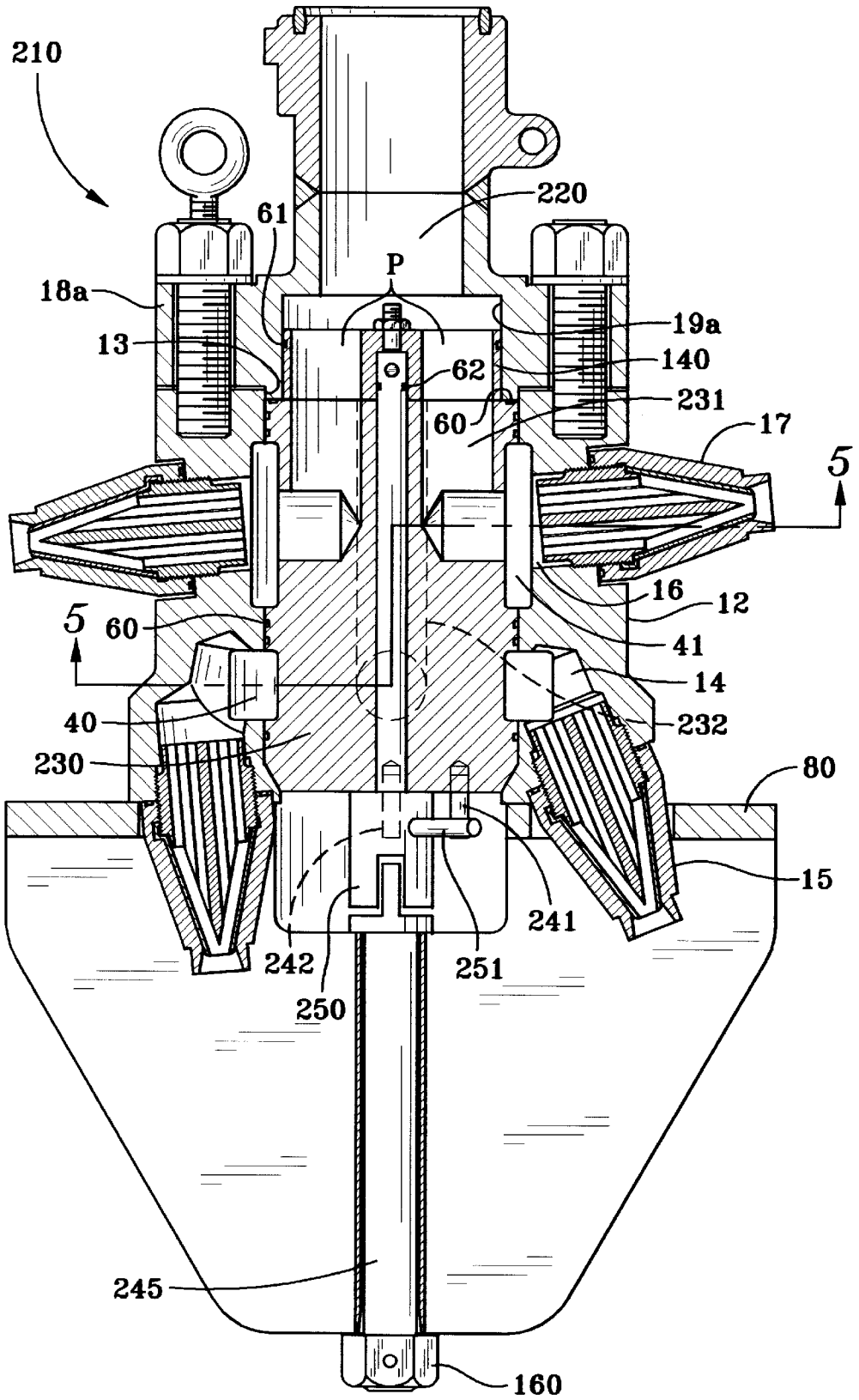
FIG. 3 is a cross-sectional elevation view of the decoking tool incorporating the valve of the invention.

FIG. 3 shows a preferred embodiment of the decoking tool 210 of the invention, which employs the valve body 12 and the mounting plate 80, as shown in FIGS. 1 and 2, and the valve body flange 18*a*, as shown in FIG. 2.

The invention provides a stationary cylindrical diversion body 230 which has axial drilling fluid passages 232 extending substantially the full length of the diversion body, and axial cutting fluid passages 231 extending approximately half as far. Passages 231, 232 end at radial outlets which communicate with an annular cutting fluid plenum 41 and an annular drilling fluid plenum 40, respectively. Drilling nozzles 15 and cutting nozzles 17 are installed in drilling nozzle sockets 14 and cutting nozzle sockets 16, and also communicate with annular drilling fluid plenum 40 and annular cutting fluid plenum 41, respectively. Seal rings 60, are installed between the wall of the bore 13 of the valve body 12 and the diversion body 230. These prevent leakage of pressurized fluid between the plenums. A diverter plate 140 lies in socket 19*a* of flange 18*a* and has seal rings 61 and 62 between the diverter plate and the socket and the upper control rod 250. The pressurized fluid forces the diverter plate firmly against the diversion body during operation. The bottom surface of the diverter plate 140 and the top surface of the diversion body 230 are lapped so that they do not need interposed seals to prevent leakage between fluid passages 231, 232 of the diversion body 230. Typically, the diverter plate 140 has two axial fluid passages P spaced 180 degrees apart, and the diversion body 230 has four passages, two drilling fluid passages 232 spaced 180 degrees apart, and two cutting fluid passages 231 also spaced 180 degrees apart, such that the drilling and cutting fluid passages are spaced 90 degrees from each other. With the drilling fluid plenum 40 and the cutting fluid plenum 41 provided, this is an effective method of distributing pressurized fluid to the drilling and cutting nozzles 15, 17, no matter how many of each are required.

Thus the fluid passages P receive pressurized fluid from the inlet 220 and direct it to either the drilling fluid passages 232 of the diversion body, or to the cutting fluid passages 231. Control rod 250 extends upward through the diversion body 230 and is keyed to the diverter plate to rotate the plate 90 degrees, in order to operate the decoking tool 210 in either the drilling or cutting mode, by occluding either the cutting fluid passages or the drilling fluid passages.

An extension (or lower control rod) 245, keyed to upper control rod 250, may be provided to allow for more remote diverter plate control. Dowels 241 and 242 project from the bottom of the diversion body 230 to provide rotation stops, against which dowel 251 of the control rod 250 makes contact, thus indicating correct positioning of the diverter plate. As shown in FIG. 3, the diverter plate 140 is in the cutting operation position.

Figure 5:
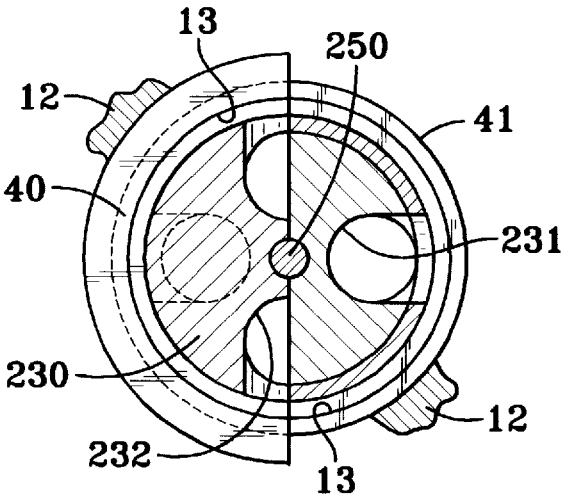
FIG. 5 is a vertical cross-sectional view along 5—5 of FIG. 3.

FIG. 5 is a vertical sectional view upward along line 5—5 of FIG. 3. Fragments of the valve body 12 are indicated, along with the axial bore 13 and the diversion body 230, as well as drilling fluid plenum 40 and drilling fluid passages 232 and cutting fluid plenum 41 and cutting fluid passages 231. Control rod 250 is seen passing through the axial center of the diversion body 230.

Because of the lapped mating surfaces of the diverter plate 140 and the diversion body 230, and because of the pressurized fluid pushing the diverter plate against the diversion body; the interface between the two surfaces is well sealed. Moreover, the assembly is simple to construct, having many fewer parts than the prior art designs, and is easy to assemble, disassemble, maintain, and operate. To change operation mode, it is only necessary to interrupt the pressurized fluid supply and turn the rotation head 160 by 90 degrees.

Optional back spray nozzles (not illustrated) may be provided, one for each drilling nozzle. These nozzles are directed approximately 45 degrees outward and upward above the drilling nozzles. They receive the pressurized fluid from the drilling fluid plenum and the drilling nozzle sockets. They are provided to assure that coke swarf does not settle on the tool and jam it in the coke bed.

Figure 4:
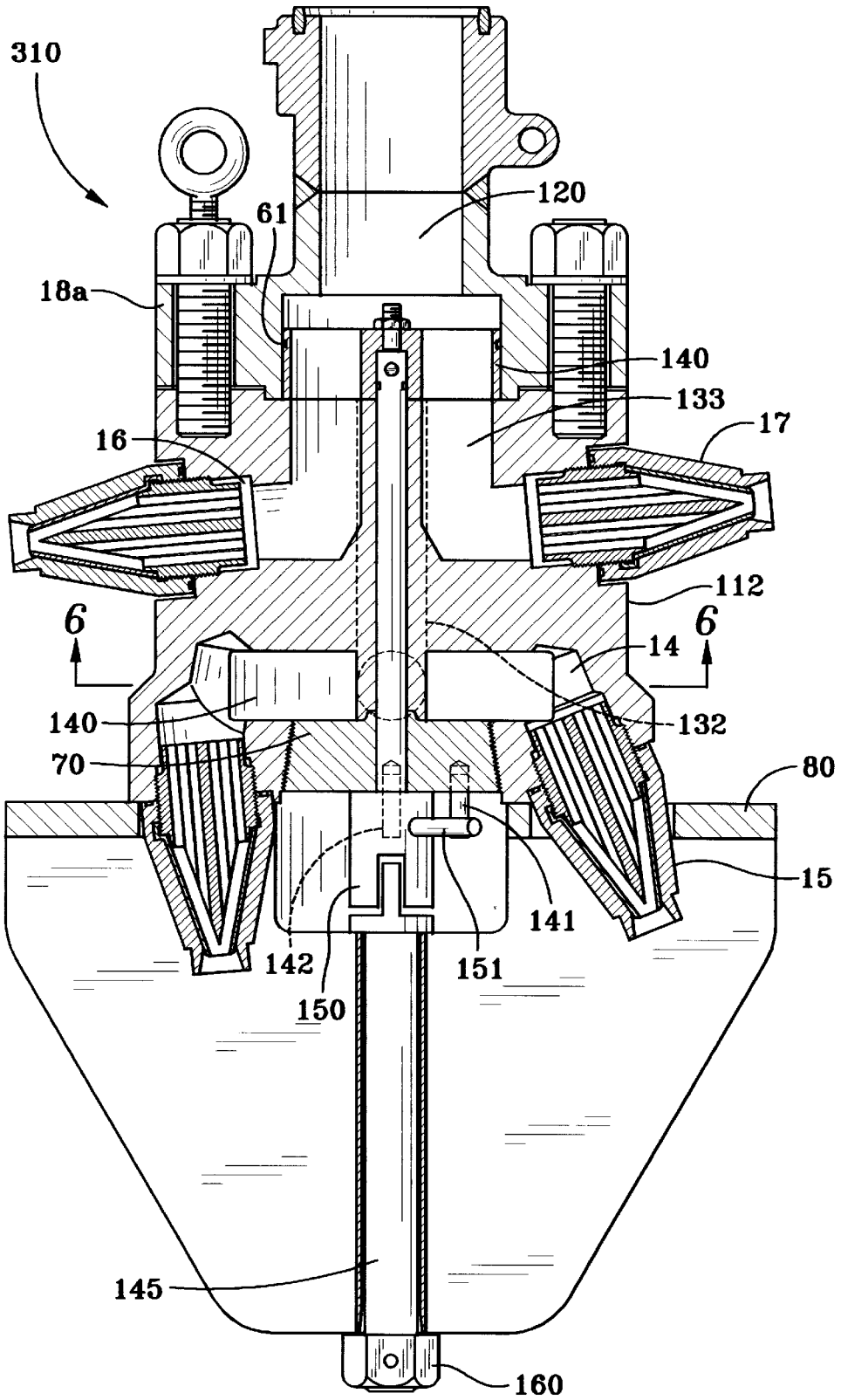
FIG. 4 is a cross-sectional elevation view of another embodiment of the decoking tool of the invention.

FIG. 4 shows another embodiment in which the decoking tool has a unitary body 112 which incorporates the diversion valve drilling and cutting fluid passages 132 and 133. A body plug 70 which seals the decoking tool provides access to make the drilling fluid plenum 140 for distributing the drilling fluid from the drilling fluid passages 132 to the drilling nozzle sockets 14 and drilling nozzles 15. The flange 18*a* with socket 19*a* still holds the diverter plate 140 interposed between the pressurized fluid inlet 120 and the tool unitary body 112. As in the previous preferred embodiment, position dowels 141 and 142, projecting from plug 70, still provide indication of operation mode by limiting the position of dowel 151 projecting horizontally from control rod 150. This indicates the rotational state of diverter plate 140.

Figure 6:
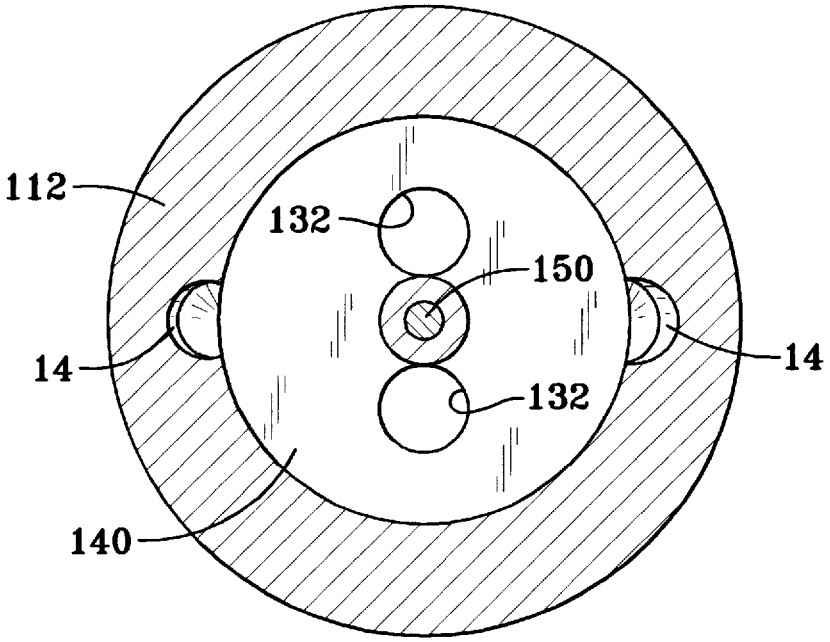
FIG. 6 is a vertical cross sectional view along 6—6 of FIG. 4.

FIG. 6 shows a vertical upward sectional view along line 6—6 of FIG. 4. The drilling fluid plenum 140 is shown as very large, but its size is only a function of hydraulic considerations and is otherwise a matter of choice in manufacturing. Nozzle sockets 14 are partially visible as well as the control rod 150. The drilling fluid passages 132 are seen to open directly into the top of drilling fluid plenum 140.

Figure 7:
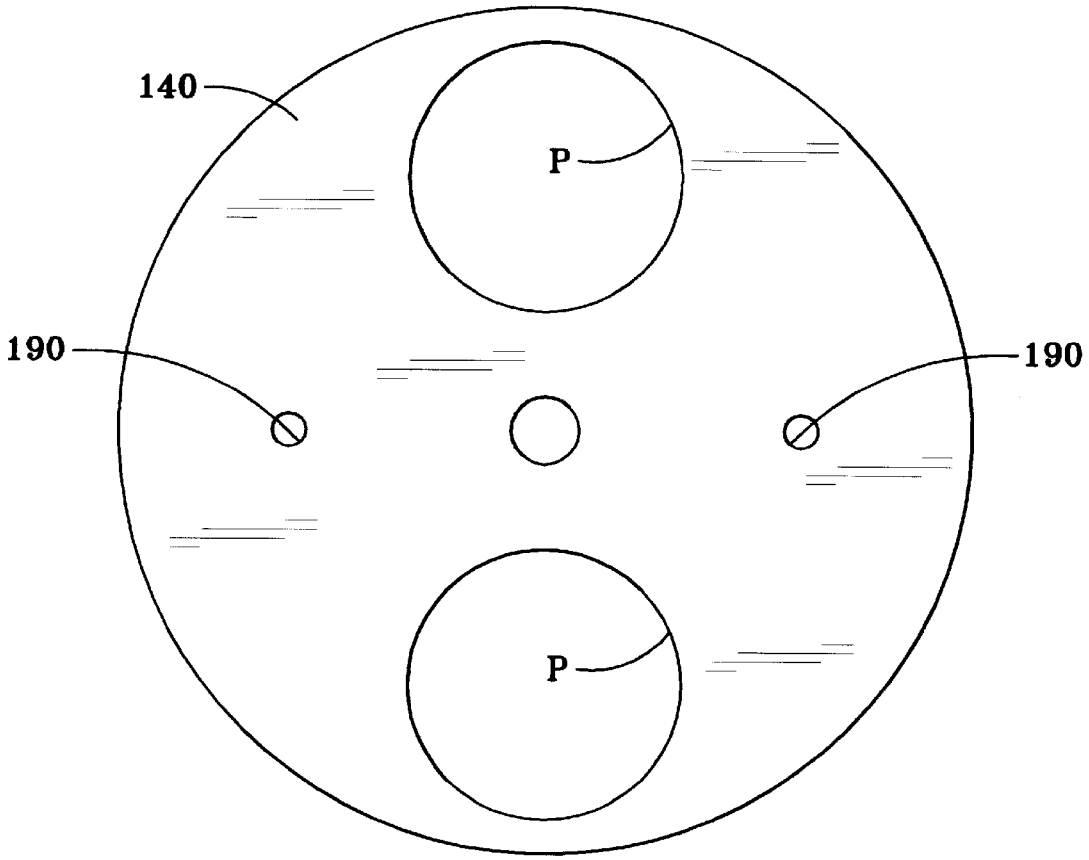
FIG. 7 is plan view illustrating features of the diverter plate.

FIG. 7 shows a schematic plan view of the diverter plate 140 and illustrates another novel feature thereof. There are two fluid passages P and two flush orifices 190. The flush orifices 190 are spaced 180 degrees from each other and 90 degrees from the fluid passages P. They are sized (about ⅛ inch diameter) such that they provide about 50 gpm of flushing fluid during operation of the tool. The flushing fluid prevents entry of coke swarf into the cutting nozzles during drilling and into the drilling nozzles during cutting. Thus the nozzles do not become plugged during their non-operating periods.

It is clear that the preferred embodiment and the second embodiment of the invention provide a much simplified assembly which is less subject to malfunctions in the hostile environment in which decoking tools are used. Since both embodiments have only one moving part in the diversion valve, they are both proportionately more reliable in service than decoking tools of the prior art.

Having described the invention, we claim:

1. A decoking tool comprising:

a valve body equipped with a pressurized fluid inlet, said body having an axis and a plurality of axially extending fluid passages, including drilling fluid passages extending substantially the full length of said valve body to conduct fluid to drilling nozzle sockets, and cutting fluid passages extending approximately half as far as said drilling fluid passages to conduct fluid to cutting nozzle sockets, said drilling and cutting fluid passages being disposed alternatingly on a circular locus about an axial centerline of said valve body;

a plurality of nozzles installed one in each of said nozzle sockets;

a diverter plate interposed between said valve body and said pressurized fluid inlet and having axial fluid passages disposed on a circular path congruent with said circular locus, the disposition of said axial fluid passages being such that said passages align either with the drilling fluid passages or with the cutting fluid passages of the valve body; and means for rotating said diverter plate to selectively provide fluid communication to either the drilling fluid passages or the cutting fluid passages.

2. The decoking tool of claim 1, wherein the means for rotating said diverter plate to selectively provide fluid communication to either the drilling fluid passages or the cutting fluid passages comprises a control rod extending along the axis of the valve body, said control rod being in driving engagement at a first end with said diverter plate and having provision at a second end for being rotatably driven.

3. The decoking tool of claim 1, further comprising:

means for flushing cutting nozzles, when drilling nozzles are in use, and drilling nozzles, when cutting nozzles are in use.

4. The decoking tool of claim 3, wherein the means for flushing comprises a plurality of flushing passages in said diverter plate, alternatingly disposed with said axial fluid passages on the same circular locus, such that said flushing passages align with cutting fluid passages of said valve body during drilling operation and with drilling fluid passages during cutting operation.

5. A decoking tool comprising:

a valve body equipped with a pressurized fluid inlet and a plurality of drilling nozzles and cutting nozzles, said body having an axis and a diversion body installed on said axis with a plurality of axially extending fluid passages, said diversion body including drilling fluid passages extending substantially the full length of said diversion body to conduct fluid to said drilling nozzle sockets, and cutting fluid passages extending approximately half as far as said drilling fluid passages to conduct fluid to said cutting nozzle sockets, said drilling and cutting fluid passages being disposed alternatingly on a circular locus about an axial centerline of said diversion valve body;

a plurality of nozzles installed one in each of said nozzle sockets;

a diverter plate interposed between said diversion body and said pressurized fluid inlet and having axial fluid passages disposed on a circular path congruent with said circular locus, the disposition of said axial fluid passages being such that said passages align either with the drilling fluid passages or with the cutting fluid passages of the diversion body; and means for rotating said diverter plate to selectively provide fluid communication to either the drilling fluid passages or the cutting fluid passages.

6. The decoking tool of claim 5, further comprising:

an annular drilling fluid plenum in said valve body, surrounding said diversion body and in fluid communication with said drilling fluid passages and said drilling nozzle sockets; and an annular cutting fluid plenum in said valve body, surrounding said diversion body and in fluid communication with said cutting fluid passages and said cutting nozzle sockets.

7. The decoking tool of claim 5, further comprising:

means for sealing between said diversion body and said valve body to confine drilling fluid to said drilling fluid passages and said drilling fluid nozzle sockets until said fluid exits from said drilling nozzles; and means for sealing between said diversion body and said valve body to confine cutting fluid to said cutting fluid passages and said cutting fluid nozzle sockets until said fluid exits from said cutting nozzles.

8. A diversion valve device for replacing a reciprocatable diverter valve member in a decoking tool having an inlet for pressurized fluid, said diversion valve device comprising:

a cylindrical diversion body, said diversion body having a plurality of axially extending fluid passages, including drilling fluid passages extending substantially the full length of said diversion body to conduct fluid to drilling nozzles, and cutting fluid passages extending approximately half as far as said drilling fluid passages to conduct fluid to cutting nozzles, said drilling and cutting fluid passages being disposed alternatingly on a circular locus about an axial centerline of said diversion valve body;

a diverter plate interposed between said diversion body and said inlet for pressurized fluid and having axial fluid passages disposed on a circular path congruent with said circular locus, the disposition of said axial fluid passages being such that said passages align either with the drilling fluid passages or with the cutting fluid passages of the diversion body; and means for rotating said diverter plate to selectively provide fluid communication to either the drilling fluid passages or the cutting fluid passages.

9. The diversion valve device of claim 8, further comprising:

means for flushing cutting nozzles, when drilling nozzles are in use, and drilling nozzles, when cutting nozzles are in use.

10. The diversion valve device of claim 9, wherein the means for flushing comprises a plurality of flushing passages in said diverter plate, alternatingly disposed with said axial fluid passages on the same circular locus, such that said flushing passages align with cutting fluid passages of said diversion body during drilling operation and with drilling fluid passages during cutting operation.

11. In a decoking tool, of the type having a pressurized fluid inlet, a valve body with a cylindrical axial bore and with a plurality of drilling nozzles and a plurality of cutting nozzles axially displaced from said drilling nozzles, a cylindrical diverter valve member disposed in said axial bore, said diverter valve member having an axial internal chamber in fluid communication with said pressurized fluid source and at least one radially directed port in fluid communication with either said drilling nozzles or said cutting nozzles, and a mechanism for aligning said at least one radial port, selectively, with either said drilling nozzles or said cutting nozzles by axially displacing said diverter valve member, the improvement resulting from replacement of said diverter valve member with a device comprising:

a cylindrical diversion body disposed fixedly within the cylindrical axial bore of said valve body, said diversion body having a plurality of axially extending fluid passages, including drilling fluid passages extending substantially the full length of said diversion body to conduct fluid to said drilling nozzles, and cutting fluid passages extending approximately half as far as said drilling fluid passages to conduct fluid to said cutting nozzles, said drilling and cutting fluid passages being disposed alternatingly on a circular locus about an axial centerline of said diversion valve body;

a diverter plate interposed between said diversion body and said pressurized fluid inlet and having axial fluid passages disposed on a circular path congruent with said circular locus, the disposition of said axial fluid passages being such that said passages align either with the drilling fluid passages or with the cutting fluid passages of the diversion body; and means for rotating said diverter plate to selectively provide fluid communication to either the drilling fluid passages or the cutting fluid passages.

* * * * *